United States Patent [19]

Altizer

[11] Patent Number: 4,977,673

[45] Date of Patent: Dec. 18, 1990

[54] ROOFING MEMBRANE

[75] Inventor: Eugene E. Altizer, Prince George, Canada

[73] Assignee: Mweld, Inc., Port Arthur, Tex.

[21] Appl. No.: 318,895

[22] Filed: Mar. 3, 1989

[51] Int. Cl.[5] ..... B26B 29/00

[52] U.S. Cl. ..... 30/294; 30/286; 30/290; 30/282

[58] Field of Search ..... 30/229, 292, 294, 290, 30/286, 282

[56] References Cited

U.S. PATENT DOCUMENTS 4,606,124 8/1986 Figuerora ..... 30/292 X

FOREIGN PATENT DOCUMENTS 39367 10/1928 Denmark ..... 30/292

*Primary Examiner*—Douglas D. Watts
*Assistant Examiner*—Willmon Fridie, Jr.
*Attorney, Agent, or Firm*—Arnold, White & Durkee

[57] ABSTRACT

An apparatus for cutting a roofing membrane is described. The apparatus includes a frame, means coupled to the frame for facilitating movement of the frame over a roofing membrane, a blade coupled to the frame for cutting the roofing membrane, and a guide member coupled to the frame for guiding the frame over the membrane. The guide member may include an edge guide and a bar coupling the edge guide to the frame. The edge guide is adapted to cooperate with an edge of the roofing membrane to move the frame along and parallel to the edge of the membrane. The guide member may be adjustable to permit the edge guide to be moved relative to the blade.

17 Claims, 1 Drawing Sheet

ROOFING MEMBRANE

BACKGROUND OF THE INVENTION

The present invention relates generally to cutting apparatus, and more specifically relates to an apparatus for cutting a roofing membrane.

A material commonly applied to building roofs is heat weldable asphalt roofing membrane. This material comes in rolls of various standard widths up to 30 inches and lengths of approximately 30 feet. The asphalt membrane may be applied to a roof surface in a variety of ways. For example, the material may be slowly rolled out onto the roof while applying heat to the underlying surface of the material before it comes in contact with the roof. Alternatively, as disclosed in U.S. Pat. No. 4,743,332 to Black, the membrane may be unrolled on the roof and a hot plate welding device may be moved under the membrane to heat the membrane and weld it to the roof surface.

Because roof surfaces may be of any dimension and may have upstanding structures which interfere with the application of the roofing membrane, it may be necessary to apply a length of roofing membrane that has a width smaller than a standard membrane width. Thus, it becomes necessary to cut the asphalt membrane so that the membrane has the required width.

Heretofore, lengths of roofing membrane have been cut using knives. The roofer must unroll the entire length of the membrane and mark the line to be cut with a chalk line. Knives are then used to cut along the chalk line. This method has the disadvantage of being not easily performed, and it is difficult to maintain a straight cut along the asphalt membrane, especially if the cut is to be made along the entire length of the membrane roll. Moreover, since the knife may extend entirely through the membrane and cut the surface underlying the membrane, the membrane must be moved away from the surface to which it is to be applied to avoid damage to underlying roof layers. This manual method of cutting the membrane is very time consuming, often requiring about one half hour to cut the length of the roll.

Accordingly, the present invention provides an apparatus whereby a roofing membrane may be easily cut to provide a non-standard width along the entire length of the membrane. Moreover, the present invention provides an apparatus whereby a straight cut in a roofing membrane may be easily made along its entire length, without damaging roofing layers underlying the membrane. It has been found that the present invention reduces the time to cut an entire length of roofing membrane from one half hour to about 1 ½ minutes.

SUMMARY OF THE INVENTION

In one preferred embodiment, the present invention provides an apparatus for cutting a length of asphalt roofing membrane. The apparatus includes a frame adapted to move over a roofing membrane. Rollers may be rotatably mounted on the frame to facilitate movement of the frame along the roofing membrane. The frame has associated with it a guide member for guiding the frame along the roof membrane. A blade is mounted on the frame to cut the roofing membrane as the frame moves over the membrane.

In one particularly preferred embodiment of the present invention, the guide member includes an edge guide adapted to move along the edge of a length of asphalt roofing membrane. A bar, coupled to the edge guide, is slidingly received in the frame enabling the edge guide to be adjusted relative to the frame. In this particularly preferred embodiment, the frame includes a securing means for releasably securing the bar to the frame.

DETAILED DESCRIPTION OF THE PREFERRED EMBODIMENT

Figure 1:
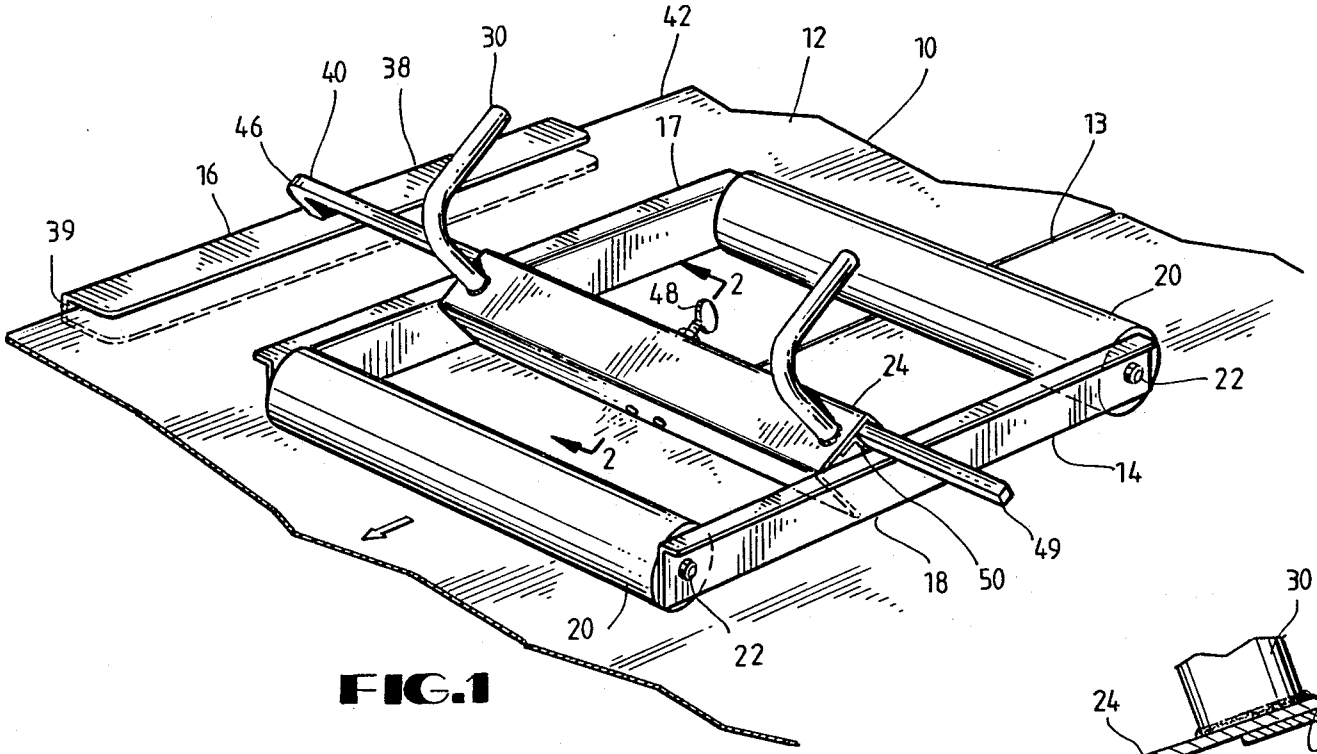
FIG. 1 depicts the cutting apparatus in accordance with the present invention.

Referring now to FIG. 1, therein is depicted one example of the cutting apparatus 10 in accordance with the present invention. Cutting apparatus 10 is adapted to move over a length of asphalt roofing membrane 12, indicated by the dashed lines in FIG. 1, and cut the membrane, as indicated at 13. Cutting apparatus 10 includes generally a frame 14, a blade 15 (FIG. 2) mounted on frame 14, and a guide member 16 adapted to guide frame 14 along roofing membrane 12.

Frame 14 has two sides 17, 18. Rollers 20 are rotatably mounted on sides 17, 18 at 22. Rollers 20 serve to both facilitate the movement of frame 14 over roofing membrane 12 and prevent buckling of membrane 12 as frame 14 moves over the membrane. While the embodiment depicted in FIG. 1 includes rollers 20, other means of facilitating the movement of frame 14 over membrane 12 are contemplated. For example, frame 14 may include runners mounted on sides 17, 18 to enable frame 14 to slide along roofing membrane 12.

Frame 14 includes a housing 24. Housing 24 serves to provide structural support for frame 14 as well as to provide a support for guide member 16, as described in more detail below. As shown in FIG. 1, housing 24 is generally channel-shaped, but other shapes, such as angle sections, are contemplated within the scope of this invention. Frame 14 may also include handles 28, 30 mounted on frame 14 to enable the user to propel frame 14 along roofing membrane 12.

Figure 2:
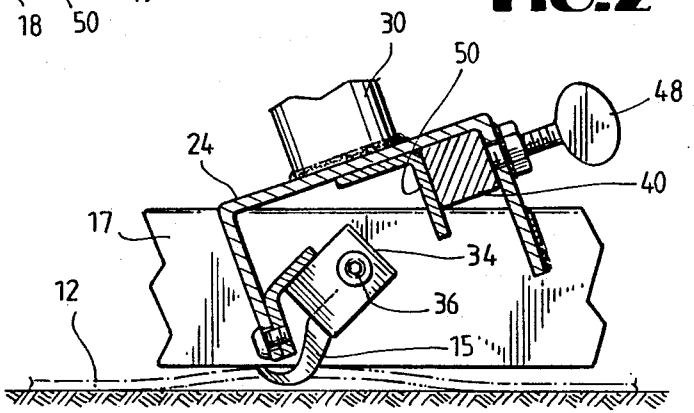
FIG. 2 is a partial cross-section of the cutting apparatus shown in FIG. 1 taken along line 2—2.

As shown in FIG. 2, blade 15 is mounted on frame 14 and is adapted to cut a roofing membrane. Blade 15 may be any number of a variety of blades, such as a standard hook blade. The use of a hook blade permits cutting apparatus 10 to be used without damaging underlying roofing layers since the hook blade lists roofing membrane 12 from the underlying surface before membrane 12 is cut. Thus, the cutting apparatus 10 permits a roofing membrane to be cut without removing the membrane from the surface where it is to be applied. Blade 15 is mounted in blade holder 34, which is mounted on housing 24. As shown in FIG. 2, blade holder 34 may include a screw fastener 36 for securing blade 15 in blade holder 34. In this manner, blade 15 may be replaced when worn. In addition, blade holder 34 may be adjustably fastened to housing 24 so that blade 15 may be moved vertically to permit more than one ply of roofing membrane to be cut at the same time.

Referring again to FIG. 1, a guide member 16 is provided for guiding frame 14 along roofing membrane 12. In the preferred embodiment, guide member 16 includes edge guide 38 and bar 40. Edge guide 38 is generally a channel-shaped member adapted to receive in channel 39 an edge 42 of roofing membrane 12.

Bar 40 serves to hold edge guide 38 in alignment with frame 14 and to movably couple edge guide 38 to frame 14. Bar 40 includes leg 46, which is joined to edge guide 38, and elongated portion 44 adapted to be received in housing 24 of frame 14. Guide member 16 is supported on frame 14 by the cooperation of bar 40 and housing 24. The length of leg 46 is such that edge guide 38 is positioned in alignment with the bottom of frame 14 when elongated portion 44 is received in housing 24.

As cutting apparatus 10 moves over and cuts roofing membrane 12, edge guide 38 slides along and parallel to an edge 42 of membrane 12. The arrangement of guide member 16 and frame 14 ensures that frame 14 likewise moves parallel to edge 42, providing a straight cut along the entire length of membrane 12. Bar 40 may have a generally square cross-section adapted to be received at a corner of housing 24. The cooperation between the bar 40 and the housing 24 maintains edge guide 38, in alignment with frame 14.

Guide member 16 is adapted to be adjusted relative to frame 14 and blade 15, to permit cut 13 to be made at different positions along the entire width of roofing membrane 12. Elongated portion 44 of bar 40 is adapted to slide in housing 24. Thus, edge guide 38 may be moved away from or toward frame 14, thereby adjusting the distance between edge guide 38 and blade 15. Such adjustment allows the width of the asphalt roofing membrane between edge 42 and cut 13 to be varied. Cutting apparatus 10 may include a means for measuring the distance between blade 15 and edge guide 38, such as a scale on bar 40.

While guide member 16 may be adjusted relative to blade 15, it is desirable to ensure that in operation, guide member 16 is fixed relative to blade 15 so that a straight cut 13 is obtained over the entire length of roofing membrane 12. Therefore, a releasable securing means, such as fastener screw 48, is provided. Fastener screw 48 releasably secures elongated portion 44 of bar 40 in housing 24. Fastener screw 48 is threaded through housing 24 and is adapted to contact bar 40. When tightened, fastener screw 48 causes bar 40 to contact plate 50, which may be formed integrally with, or welded to, the underside of housing 24. Friction engagement of fastener screw 48, bar 40 and plate 50 secures bar 40 in housing 24, thereby releasably securing guide member 16 relative to frame 14 and blade 15. If guide member 16 is to be adjusted, fastener screw 48 may be loosened, permitting elongated portion 44 of bar 40 to slide in housing 24.

The operation of cutting apparatus 10 is as follows. If a width of asphalt roofing membrane is required that is less than the standard width of an asphalt roofing membrane roll, as for example, along the edge of a roof surface or adjacent an upstanding structural member, the operator first determines the width of the roofing membrane required. Edge guide 38 is then positioned relative to blade 15 so that the distance between edge guide 38 and blade 15 corresponds to the width of the asphalt roofing membrane required. It should be observed that an operator may position edge guide 38 relative to blade 15 so that the portion of roofing membrane 12 disposed between edge guide 38 and blade 15 is the portion to be applied to the roof surface. Alternatively, the operator may position edge guide 38 relative to blade 15 so that the excess width of roofing membrane 12 not to be applied to the roof surface is disposed between edge guide 38 and blade 15.

After edge guide 38 is positioned relative to blade 15, fastener screw 48 is tightened, causing elongated portion 44 of bar 40 to come into friction engagement with plate 50. The tightening of fastener screw 48 secures edge guide 38 relative to blade 15.

One end of a length of asphalt roofing membrane is placed under frame 14, and frame 14 is positioned so that edge guide 38 is placed in contact with one edge of the membrane. Blade 15 is brought into contact with the roofing membrane, and frame 14 and guide member 16 are moved along the roofing membrane using the edge of the roofing membrane as a guide. In this manner, an entire length of asphalt roofing membrane may be cut easily while maintaining the cut parallel to one edge of the membrane over its entire length.

Many modifications and variations may be made in the techniques and structures described and illustrated herein without departing from the spirit and scope of the present invention. For example, in the embodiment depicted in FIGS. 1 and 2, edge guide 38 is adjustable relative to blade 15 through the provision of structural elements permitting edge guide 38 to move relative to frame 14. Alternatively, edge guide 38 could be fixed relative to frame 14, and structure could be provided enabling blade 15 to be moved on frame 14 to vary the distance between blade 15 and edge guide 38. Accordingly, the techniques and structures described herein are illustrative only and are not to be considered as limitations upon the scope of the present invention.

What is claimed is:

1. Apparatus for cutting a roofing membrane, comprising:

a frame having two sides and a housing mounted between and interconnecting said two sides;

said housing having first and second spaced apart plate members;

a roller rotatably mounted between said two sides and adapted to facilitate movement of said frame over said roofing membrane;

a guide member adjustably coupled to said housing for guiding said frame over said roofing membrane relative to an edge of said roofing membrane;

said guide member comprising:

an edge guide adapted to move along the edge of said roofing membrane, a bar coupled to said edge guide and slidably received between said first and second plate members in said housing; and means for releasably securing said bar between said first and second plate members whereby said guided member is adjustably moveable relative to said frame; and a blade mounted on said frame and adapted to cut said roofing membrane.

2. The apparatus of claim 1, wherein said means for releasably securing said bar comprises a fastener screw threadedly extending through said first plate member and adapted to force said bar into friction engagement between said second plate member and said fastener screw.

3. The apparatus of claim 1, wherein said blade is a hook blade.

4. The apparatus of claim 1, including means for adjusting said blade in a direction generally toward and away from said roofing membrane.

5. The apparatus of claim 1, wherein said roller has a membrane engaging surface with a width substantially corresponding to the distance between said two frame sides.

6. The apparatus of claim 1, wherein said roller includes a first and second spaced apart roller with each roller having a membrane engaging surface with a width substantially corresponding to the distance between said two frame sides.

7. The apparatus of claim 1, wherein said edge guide includes a first surface spaced from and generally parallel to said two frame sides and having at least a portion of said first surface intersecting a plane defined by the roof engaging portion of said roller.

8. The apparatus of claim 1, wherein said edge guide includes a first, second, and third surface, said first surface being adapted to engage the edge of said roofing membrane, said second surface being connected to and extending generally perpendicularly from said first surface and being adapted to extend beneath the roofing membrane and engage a lower surface of said roofing membrane, and said third surface being connected to and extending generally perpendicularly from said first surface in spaced apart relation with said second surface and being adapted to extend above the roofing membrane and engage an upper surface of said roofing membrane.

9. An apparatus for cutting a roofing membrane, comprising:

a frame having two sides and a housing mounted between and interconnecting said two sides;

said housing having first and second spaced apart plate members;

a roller rotatably mounted between said two sides and adapted for engaging said roofing membrane and facilitating movement of said frame over said roofing membrane;

a guide member adjustably connect to said frame for guiding said frame over said roofing membrane at a preselected distance from an edge of said roofing membrane;

said guide member comprising:

an edge guide adapted to move along the edge of said roofing membrane, a bar coupled to said edge guide and slidably received between said first and second plate members in said housing; and a fastener screw threadedly extending through said first plate member and adapted to force said bar into friction engagement between said second plate member and said fastener screw, whereby the distance between said edge guide and said frame is adjustable; and a blade mounted on said frame and adapted to cut said roofing membrane.

10. An apparatus, as set forth in claim 9, wherein said blade is a hook blade.

11. An apparatus, as set forth in claim 9, including means for adjusting said blade in a direction generally toward and away from said roofing membrane.

12. An apparatus, as set forth in claim 9, wherein said roller has a membrane engaging surface with a width substantially corresponding to the distance between said two frame sides.

13. An apparatus, as set forth in claim 9, wherein said roller includes a first and second spaced apart roller with each roller having a membrane engaging surface with a width substantially corresponding to the distance between said two frame sides.

14. An apparats, as set forth in claim 9, wherein said edge guide includes a first surface spaced from and generally parallel to said two frame sides and having at least a portion of said first surface intersecting a plane defined by the roof engaging portion of said roller.

15. An apparatus, as set forth in claim 9, wherein said edge guide includes a first, second, and third surface, said first surface being adapted to engage the edge of said roofing membrane, said second surface being connected to and extending generally perpendicularly from said first surface and being adapted to extend beneath the roofing membrane and engage a lower surface of said roofing membrane, and said third surface being connected to and extending generally perpendicularly from said first surface in spaced apart relation with said second surface and being adapted to extend above the roofing membrane and engage an upper surface of said roofing membrane.

16. An apparatus for cutting a roofing membrane, comprising;

a frame having two sides and a housing mounted between and interconnecting said two sides;

said housing having first and second spaced apart plate members;

first and second rollers rotatably mounted between said two sides, each roller having a membrane engaging surface with a width substantially corresponding to the distance between said two sides, said rollers being adapted for engaging said roofing membrane and facilitating movement of said frame over said roofing membrane;

a guide member adjustably connected to said frame for guiding said frame over said roofing membrane at a preselected distance from an edge of said roofing membrane;

said guide member comprising;

an edge guide having a first, second, and third surface, at least a portion of said first surface intersecting a plane defined by the roof engaging portion of said first and second rollers whereby said first surface engages the edge of said roofing membrane, said second surface being connected to and extending generally perpendicularly from said first surface and being adapted to extend beneath the roofing membrane and engage a lower surface of said roofing membrane, and said third surface being connected to and extending generally perpendicularly from said first surface in spaced apart relation with said second surface and being adapted to extend above the roofing membrane and engage an upper surface of said roofing membrane, a bar coupled to said edge guide and slidably received between said first and second plate members in said housing; and a fastener screw threadedly extending through said first plate member and adapted to force said bar into friction engagement between said second plate member and said fastener screw, whereby the distance between said edge guide and said frame is adjustable;;

a blade mounted on said frame and adapted to cut said roofing membrane; and means for adjusting said blade in a direction generally toward and away from said roofing membrane.

17. An apparatus, as set forth in claim 16, wherein said blade is a hook blade.

* * * * *